US005476048A

United States Patent [19]

Yamashita et al.

[11] Patent Number: 5,476,048

[45] Date of Patent: Dec. 19, 1995

[54] PALLET FOR STORAGE AND TRANSPORTATION OF GOODS

[75] Inventors: Toshio Yamashita, Nishi-Kasugai; Tatsuro Sasaki, Tokyo, both of Japan

[73] Assignees: Mitsubishi Jukogyo Kabushiki Kaisha; Mitsui O.S.K. Lines, Ltd., both of Tokyo, Japan

[21] Appl. No.: 10,400

[22] Filed: Jan. 28, 1993

[30] Foreign Application Priority Data

Jan. 30, 1992 [JP] Japan ..... 4-015185

[51] Int. Cl.[6] ..... B65D 19/00

[52] U.S. Cl. ..... 108/51.1; 108/901

[58] Field of Search ..... 108/51.1, 901; 62/239, 373, 374

[56] References Cited

U.S. PATENT DOCUMENTS

| | | | |
|---|---|---|---|
| 3,440,976 | 4/1969 | Burne | 108/51.1 |
| 3,677,200 | 7/1972 | Coccagna et al. | 108/901 X |
| 3,759,194 | 9/1973 | Fujii et al. | 108/901 X |
| 4,467,612 | 8/1984 | Weasel, Jr. | 108/51.1 X |
| 4,991,402 | 2/1991 | Saia, III | 62/239 X |
| 5,101,643 | 4/1992 | Hicks | 108/51.1 X |

FOREIGN PATENT DOCUMENTS

| | | |
|---|---|---|
| 61-37662 | 10/1986 | Japan . |
| 1189773 | 4/1970 | United Kingdom . |
| 2209385 | 5/1989 | United Kingdom . |

*Primary Examiner*—Jose V. Chen
*Attorney, Agent, or Firm*—Wenderoth, Lind & Ponack

[57] ABSTRACT

A pallet for the cold storage or transportation of goods consists virtually of a single framework molded from a plastics material, and having a hollow interior filled with a refrigerant without the aid of any bag.

7 Claims, 1 Drawing Sheet

PALLET FOR STORAGE AND TRANSPORTATION OF GOODS

BACKGROUND OF THE INVENTION

1. Field of the Invention

This invention relates to a pallet on which goods are placed for cold storage or transportation.

2. Description of the Prior Art

There has long been known a pallet which is usually made of wood or metal, and on which goods are placed for cold storage or transportation in, for example, a refrigerator container which is loaded or unloaded by a forklift. The use of the known pallet has, however, given rise to a serious problem, i.e., during the handling or transportation of cold or frozen goods, they obtain a higher temperature by absorbing heat from the pallet and thereby become lower in quality.

In view of the above problem, Japanese Utility Model Publication No. Sho 61-37622 has proposed a pallet having a refrigerating power. It comprises a plurality of hollow deck boards made of aluminum, and held together at both ends by beams, and each containing a polyethylene bag which holds a refrigerant for keeping goods cold. The proposed pallet has, however, a number of drawbacks. As it is composed of a large number of parts, its fabrication calls for a great deal of time and labor and the pallet is, therefore, expensive. Moreover, it is not easy to fit the bag in intimate contact with the inner surface of the deck board, but a layer of air is very likely to form between the deck board and the bag and have an adverse effect on the conduction of heat therebetween and thereby the effective cooling of the goods by the refrigerant.

SUMMARY OF THE INVENTION

Under these circumstances, it is an object of this invention to provide a pallet for the storage or transportation of goods which can effectively keep the goods cold by employing a refrigerant, and yet which is free from any possibility of being corroded by the refrigerant.

It is another object of this invention to provide a pallet which has only a small number of parts and can be fabricated easily and at a low cost.

It is still another object of this invention to provide a pallet which is suitable for transportation by a forklift.

These objects are essentially attained by a pallet which comprises a single framework formed from a plastics material, and having a hollow interior filled directly with a refrigerant.

The refrigerant fills the hollow interior of the framework directly, i.e. without the aid of any bag, and therefore, can effectively keep cold the goods carried on the pallet. The framework is not corroded by the refrigerant contacting it directly, since it is formed from a plastics material. As the framework can be molded as a single body, the pallet of this invention consists virtually solely of the framework and can, therefore, be constructed easily and at a low cost, as compared with the known pallet of the type containing a refrigerant.

The pallet preferably has two sets of holes each adapted for receiving a prong of a forklift therein.

Other features and advantages of this invention will become apparent from the following description and the accompanying drawing.

DETAILED DESCRIPTION OF THE INVENTION

Figure 1:
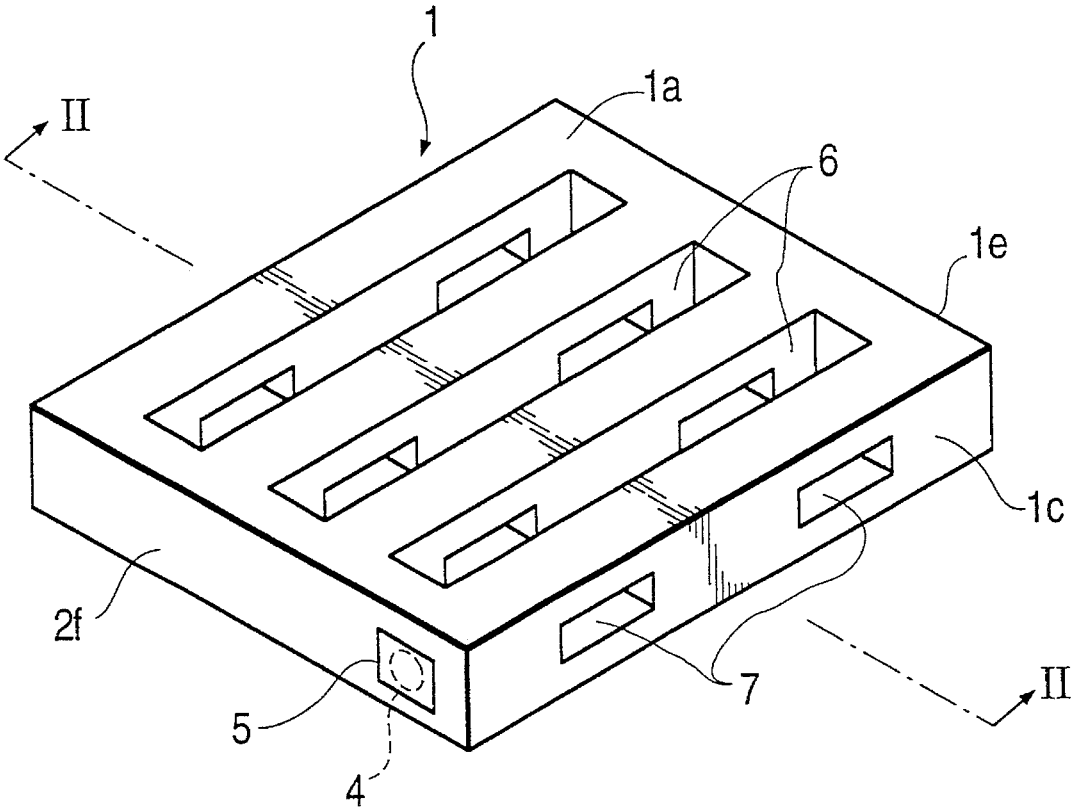
FIG. 1 is a perspective view of a pallet embodying this invention.
Figure 2:
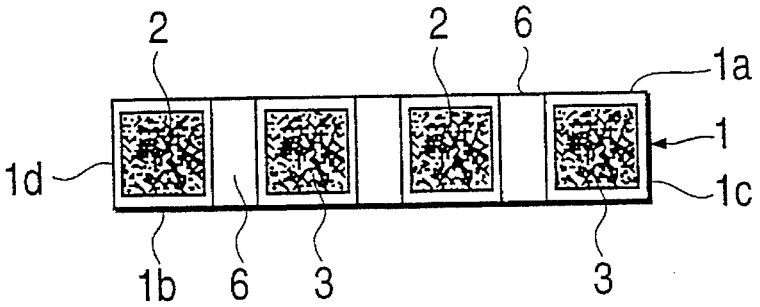
FIG. 2 is a sectional view taken along the line II—II of FIG. 1.

A pallet embodying this invention is shown in the drawing, and comprises a rectangular framework 1 molded from a plastics material, such as polyethylene, polyvinyl chloride, or glass fiber-reinforced plastics, and having a hollow interior. The framework 1 has a top face 1*a*, a bottom face 1*b*, a first pair of opposite side faces 1*c* and 1*d*, and a second pair of opposite side faces 1*e* and 1*f*. The framework 1 has a plurality of slots 6 extending in parallel to the side faces 1*c* and 1*d* and terminating somewhat inwardly of the side faces 1*e* and 1*f*, respectively. The slots 6 are open at the top and bottom faces 1*a* and 1*b* of the framework 1 to allow the passage of cold air therethrough when the pallet stays in a refrigerator.

The slots 6 divide the framework 1 into a plurality of elongate compartments 2 extending parallel to the side faces 1*c* and 1*d* of the framework 1 and connected with one another along the side faces 1*e* and 1*f*, respectively. The compartments 2 are filled with a refrigerant 3. The refrigerant 3 may, for example, be composed of water, and an organic compound such as alcohol or glycol, or an inorganic salt such as sodium or calcium chloride. It performs a cooling action by absorbing sensible or latent heat.

The framework 1 has a port 4 formed in one of its side faces 1*f* for admitting the refrigerant 3. After the compartments 2 have been filled with the refrigerant 3, the port 4 is closed by an adhesively bonded cover 5, or a plug (not shown).

The framework 1 has two parallel sets of holes 7 aligned with one another and formed through the framework portions defining the compartments 2 at right angles thereto. The two sets of holes 7 are appropriately spaced apart from each other for receiving two prongs, respectively, of a forklift which will be employed for lifting and carrying the pallet.

If the pallet carrying goods thereon is placed in a refrigerator container, the refrigerant can keep the goods cold, even when the refrigerator is out of order. If the pallet is pre-cooled, it is possible to keep the goods cold and avoid any undesirable change in quality thereof for a certain length of time before the pallet is placed in a refrigerator container, or after its removal therefrom.

As the pallet is a product molded from a plastics material which is resistant to corrosion by the refrigerant, the refrigerant can be employed to fill its hollow interior without the aid of any bag. Therefore, the pallet of this invention is simpler in construction, and easier to fabricate than the known pallet containing a refrigerant, and yet can keep the goods cold effectively.

What is claimed is:

1. A pallet for the storage or transportation of goods which comprises a one-piece hollow framework of plastic, and a refrigerant filling, in direct contact with, and enclosed by said hollow framework.

2. A pallet as set forth in claim 1, wherein said framework is rectangular and has two pairs of side surfaces, and a plurality of elongate compartments extending parallel to one of said pairs of side surfaces and connected with one another along the other of said pairs of side surfaces.

3. A pallet as set forth in claim 2, wherein said framework has a plurality of slots which are open at both of its top and bottom surfaces, said slots extending parallel to said compartments and alternately disposed therewith.

4. A pallet as set forth in claim 3, wherein said framework has a port extending through a side of the pallet and through which port said hollow framework can be filled with said refrigerant, and a cover tightly closing said port.

5. A pallet as set forth in claim 1, wherein said framework has two parallel sets of holes aligned with one another in directions extending at right angles to said compartments and sized to accommodate two prongs, respectively, of a forklift.

6. A pallet as set forth in claim 2, wherein said framework has a port extending through a side of the pallet and through which port said hollow framework can be filled with said refrigerant, and a cover tightly closing said port.

7. A pallet as set forth in claim 6, wherein said framework has two parallel sets of holes aligned with one another in directions extending at right angles to said compartments and sized to accommodate two prongs, respectively, of a forklift.

* * * * *